US010271144B2

(12) United States Patent
Nakajima et al.

(10) Patent No.: US 10,271,144 B2
(45) Date of Patent: Apr. 23, 2019

(54) SPEAKER UNIT

(71) Applicant: FUJITSU TEN LIMITED, Kobe-shi, Hyogo (JP)

(72) Inventors: Yuichi Nakajima, Kobe (JP); Kayo Takamatsu, Kobe (JP)

(73) Assignee: FUJITSU TEN LIMITED, Kobe (JP)

( * ) Notice: Subject to any disclaimer, the term of this patent is extended or adjusted under 35 U.S.C. 154(b) by 0 days.

(21) Appl. No.: 15/466,915

(22) Filed: Mar. 23, 2017

(65) Prior Publication Data

US 2017/0295433 A1 Oct. 12, 2017

(30) Foreign Application Priority Data

Apr. 11, 2016 (JP) ..... 2016-079056

(51) Int. Cl.

| | |
|---|---|
| ***H04R 1/02*** | (2006.01) |
| ***H04R 1/28*** | (2006.01) |
| ***H04R 7/12*** | (2006.01) |
| ***H04R 7/18*** | (2006.01) |
| ***H04R 9/06*** | (2006.01) |

(52) U.S. Cl.

CPC ..... *H04R 9/06* (2013.01); *H04R 1/023* (2013.01); *H04R 1/2811* (2013.01); *H04R 7/127* (2013.01); *H04R 7/18* (2013.01); *H04R 2400/11* (2013.01); *H04R 2499/13* (2013.01)

(58) Field of Classification Search

CPC . H04R 9/06; H04R 7/127; H04R 7/18; H04R 2400/11; H04R 2499/13; H04R 1/023; H04R 1/2811

USPC ..... 381/348, 389, 398, 433

See application file for complete search history.

(56) References Cited

U.S. PATENT DOCUMENTS

| | | | | |
|---|---|---|---|---|
| 8,150,095 | B2 * | 4/2012 | Kemmerer | H04R 9/022 381/150 |
| 2003/0091212 | A1 * | 5/2003 | Nakada | H04R 9/02 381/433 |
| 2006/0188124 | A1 * | 8/2006 | Sasaki | H04R 1/22 381/386 |
| 2008/0025549 | A1 * | 1/2008 | Avera | H04R 9/022 381/397 |

FOREIGN PATENT DOCUMENTS

| | | |
|---|---|---|
| CN | 1822706 A | 8/2006 |
| WO | 2009/144818 A1 | 12/2009 |

* cited by examiner

*Primary Examiner* — Davetta W Goins
*Assistant Examiner* — Daniel R Sellers
(74) *Attorney, Agent, or Firm* — Oliff PLC

(57) ABSTRACT

A speaker unit according to an embodiment includes a diaphragm, a frame, and a current plate. The frame supports an outer circumferential portion of the diaphragm. The current plate is provided in the frame so as to be located at a backside of the diaphragm, and its principal surface is arranged in a direction along an amplitude direction of the diaphragm.

9 Claims, 5 Drawing Sheets

SPEAKER UNIT

CROSS-REFERENCE TO RELATED APPLICATION

This application is based upon and claims the benefit of priority of the prior Japanese Patent Application No. 2016-079056, filed on Apr. 11, 2016, the entire contents of which are incorporated herein by reference.

FIELD

The embodiment discussed herein is directed to a speaker unit.

BACKGROUND

There is known a conventional speaker unit that is provided to be embedded in an interior member such as a door of a vehicle and includes a damping member provided on the backside of a diaphragm of a speaker to absorb a back pressure (for example, see International Publication Pamphlet No. WO2009/144818).

However, because the above conventional technology is required to install a damping member separately from a speaker, it is concerned that a speaker unit has a complicated configuration as a whole.

SUMMARY a speaker unit according to an embodiment, includes a diaphragm, a frame, and a current plate. the frame that supports an outer circumferential portion of the diaphragm, the current plate that is provided in the frame so as to be located at a backside of the diaphragm, a principal surface of the current plate being arranged in a direction along an amplitude direction of the diaphragm.

BRIEF DESCRIPTION OF DRAWINGS

A more complete appreciation of the embodiment and many of the attendant advantages thereof will be readily obtained as the same becomes better understood by reference to the following detailed description when considered in connection with the accompanying drawings, wherein.

DESCRIPTION OF EMBODIMENT

Figure 1A:
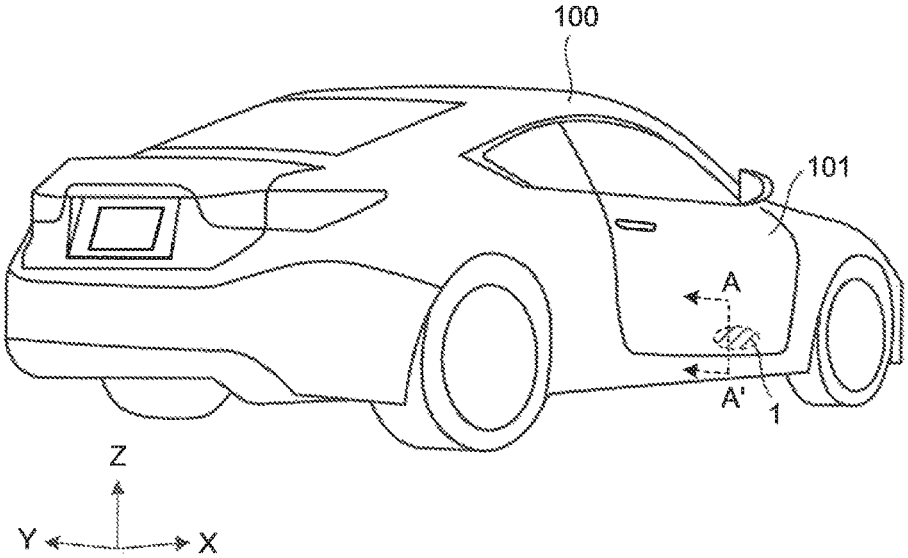
FIG. 1A is a perspective diagram illustrating an example of a mounted state of a speaker unit according to an embodiment.
Figure 1B:
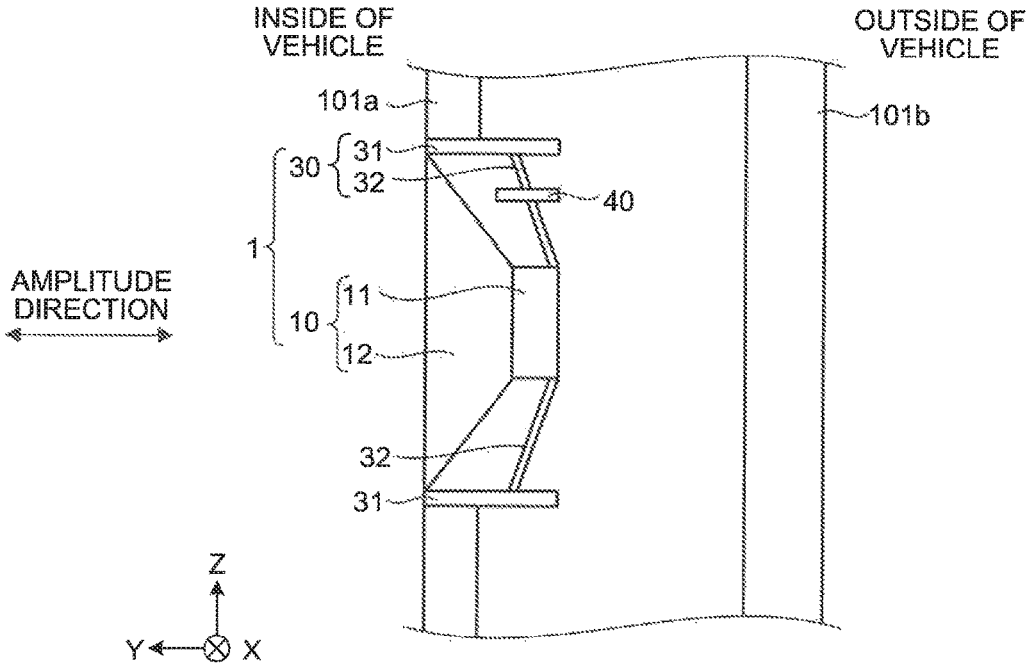
FIG. 1B is a schematic diagram illustrating an attached state of the speaker unit according to the embodiment.

Hereinafter, an embodiment of a speaker unit disclosed in the present application will be described in detail with reference to the accompanying drawings. This invention is not limited to the embodiment described below. Moreover, in order to make an explanation understandable, FIGS. 1A and 1B illustrate a three-dimensional rectangular coordinate system including the Z axis whose vertically upward direction is a positive direction. The rectangular coordinate system may be illustrated in other drawings that are used for the following explanations.

First, the outline of a speaker unit according to an embodiment will be explained with reference to FIGS. 1A and 1B. FIG. 1A is a perspective diagram illustrating an example of a mounted state of a speaker unit I according to the embodiment. FIG. 1B is a schematic diagram illustrating an attached state of the speaker unit 1 according to the embodiment. Moreover, FIG. 1B is equivalent to a schematic diagram obtained by cutting a door 101 illustrated in FIG. 1A toward the positive direction of the Y axis along the A-A' line and viewing the cut door 101 from the negative direction toward the positive direction of the X axis as illustrated in FIG. 1A.

As illustrated in FIG. 1A, the speaker unit 1 according to the embodiment is placed to be embedded in the door 101 of a vehicle 100, for example, and reproduces voice signals from a device (hereinafter, simply referred to as "device") such as car navigation and audio installed on the vehicle 100.

More specifically, as illustrated in FIG. 1B, the speaker unit 1 includes a speaker 10, a frame 30, and current plates 40. Moreover, the speaker unit 1 is attached to an inner panel 101*a* of the vehicle 100 in such a manner that a voice output direction, namely, a front side of a diaphragm 12 to be described later becomes the inside of the vehicle.

The speaker 10 includes a vibrating part 11 and the diaphragm 12. The vibrating part 11 includes a voice coil, a damper, and the like, and vibrates in accordance with signals from the device as described above. The vibrating part 11 is placed so that its one end contacts the diaphragm 12, and vibrates the diaphragm 12 in accordance with its own vibration. Moreover, as illustrated in FIG. 1B, the vibrating part 11 is attached to arms 32 so as to be located at the backside of the diaphragm 12. Moreover, the diaphragm 12, the voice coil, a dust cap, and the damper vibrate along with the vibrating part 11.

The diaphragm 12 vibrates circumambient air by vibrating in accordance with the vibration of the vibrating part 11 to generate sound toward the inside of the vehicle 100. Moreover, the amplitude direction of the diaphragm 12 is a direction along the Y axis illustrated in FIG. 1B.

The diaphragm 12 is a cone-shaped diaphragm of which the outer circumferential portion is supported by the frame 30 and the central portion protrudes toward the outside of the vehicle in comparison with the outer circumferential portion. Moreover, materials of the diaphragm 12 are pulp for example. However, the materials may be resin such as polyester or metal such as aluminum.

The frame 30 includes a chassis 31 and the arms 32. The chassis 31 is a tubular chassis that supports the outer circumferential portion of the diaphragm 12 and in which the front and back sides of the diaphragm 12 are open ends.

The arms 32 are, for example, a rod-shaped member provided from the outer circumferential portion of the chassis 31 toward the vibrating part 11, and supports the vibrating part 11 and the current plates 40 to be described later. Moreover, the details of the frame 30 are explained below with reference to FIG. 3.

In the meantime, due to the vibration of the diaphragm 12, an air current is generated at the backside of the diaphragm 12, namely, in a sp ace between the speaker unit 1 and an outer panel 101*b*. Then, when the air current is reflected on the outer panel 101*b*, an eddy is generated in the space as described above.

As described above, because an air current is disturbed when an eddy is generated in the space between the speaker unit 1 and the outer panel 101*b*, the movement of the diaphragm 12 is obstructed, and thus sound quality is degraded like reproduced sound becomes dull.

Therefore, the speaker unit 1 according to the embodiment includes the current plates 40 that are provided at the backside of the diaphragm 12. As described above, it is possible to suppress the generation of an eddy as described above to improve sound quality by providing the current plates 40 at the backside of the diaphragm 12. Hereinafter, the current plates are specifically explained.

The current plates 40 are, for example, a rectangular plate and are supported by the arms 32 as described above. Moreover, the principal surfaces of the current plates 40 are placed in a direction along the amplitude direction of the diaphragm 12. A space located at the backside of the diaphragm 12 can be efficiently divided by arranging the current plates 40 in such a direction. Moreover, a degree of freedom of an air current is limited in the divided space, and thus the generated eddy is restricted.

Therefore, according to the speaker unit 1 that includes the current plates 40, sound quality can be improved because an eddy caused by an air current is reduced. Moreover, according to the embodiment, because it is only necessary that the speaker unit 1 includes the current plates 40 from the viewpoint of the improvement of sound quality, sound quality can be improved by a simplified structure.

In FIG. 1B, although it has been illustrated that the current plate 40 is parallel to an XY plane, the attachment direction may have any direction if the principal surface of the current plate 40 is located along the Y axis. As described above, according to the embodiment, even if the speaker unit 1 is under an attachment environment in which an eddy of an air current such as the reflection of the air current from the backside is easily generated like the speaker unit 1 is placed to be embedded in the door 101 of the vehicle 100, high-quality sound can be provided to the inside of the vehicle.

In FIG. 1B, although it has been illustrated that the current plate 40 is placed parallel to the amplitude direction of the diaphragm 12, the present invention is not limited to this. The current plate 40 may be inclined in the range of +10 degrees and −10 degrees from the Y axis, for example. Moreover, in FIG. 1B, it has been illustrated that the current plate 40 does not protrude from the backside of the chassis 31. However, the present invention is not limited to this. The current plate 40 may be placed to protrude from the chassis 31.

In the meantime, the general vehicle 100 has a structure that a drop of water falls from the upper side into a space between the inner panel 101*a* and the outer panel 101*b* during car washing or rainy weather. When the drop of water directly falls onto the diaphragm 12, the normal vibration of the diaphragm 12 is obstructed and thus sound quality is decreased. Moreover, because the falling sound of a drop of water is generated when the drop of water directly falls onto the diaphragm 12, sound that does not hear under normal conditions is consequently heard to a user. In other words, when abnormal noise is generated from the speaker unit 1, the user feels it.

However, a drop of water may directly fall onto the diaphragm 12 depending on an attachment direction like the front side of the speaker unit 1 is attached obliquely downward. Moreover, the drop of water may be generated by dew condensation.

Therefore, in the speaker unit 1 according to the embodiment, the current plate 40 blocks the fall of a drop of water onto the diaphragm 12. In other words, the current plate 40 further has a function that acts as a waterproof plate of the diaphragm 12.

By doing so, because the drop of water does not fall onto the diaphragm 12, the degradation sound quality caused by a drop of water can be suppressed. Moreover, this point will be explained in detail with reference to FIGS. 2 to 5.

Figure 2:
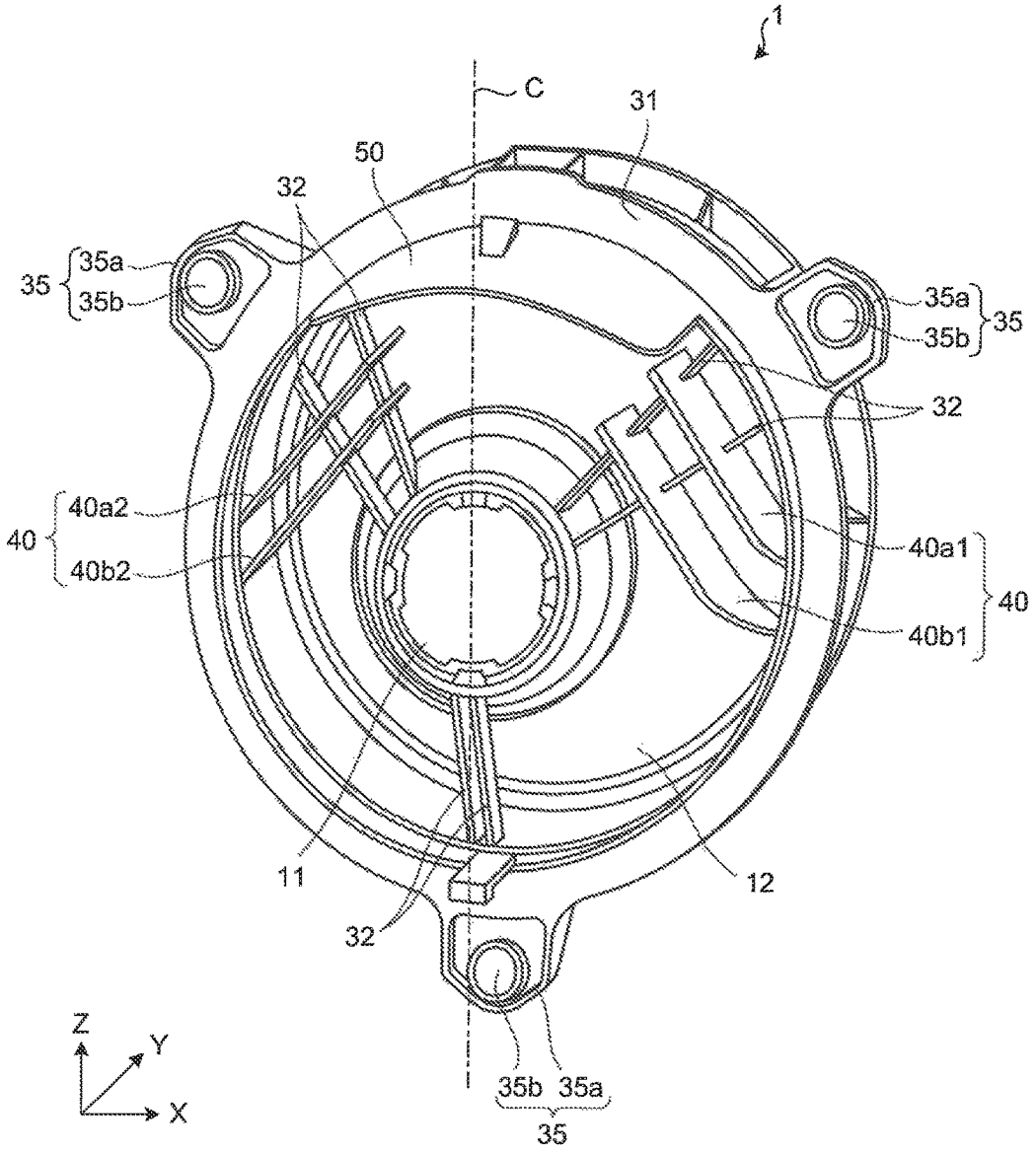
FIG. 2 is a perspective diagram illustrating a backside of the speaker unit according to the embodiment.

Hereinafter, the speaker unit 1 according to the embodiment will be further explained. First, the structure of the speaker unit 1 according to the embodiment will he explained with reference to FIG. 2. FIG. 2 is a perspective diagram illustrating tie backside of the speaker unit 1 according to the embodiment.

As illustrated in FIG. 2, the speaker unit 1 includes the vibrating part 11, the diaphragm 12, the chassis 31, the arms 32, attaching parts 35, the current dates 40, and a shading part 50. Because the vibrating part 11 and the diaphragm 12 have been already explained by using FIG. 1B, their explanations are omitted.

The chassis 31 is a tubular chassis that supports the outer circumferential portion of the diaphragm 12. In FIG. 2, a case where the chassis 31 is a cylindrical chassis is illustrated because the diaphragm 12 has a cone-like shape.

The arms 32 support the vibrating part 11 located in the center of the chassis 31 in planar view. Moreover, the arms 32 are radially arranged from the vibrating part 11 toward its outer circumference at a slant to accord with the shape of the diaphragm 12, for example.

Each of the attaching parts 35 includes a protrusion 35*a* and an attaching hole 35*b*. The protrusions 35*a* are arranged to protrude in a radial direction from the outer circumferential portion of the chassis 31. The attaching holes 35*b* are openings provided in the protrusions 35*a*. The speaker unit 1 can be attached to an attaching target (the door 101 illustrated in FIG. 1A) by attaching attachment members such as bolts to the attaching holes 35*b*.

The current plates 40 are a plate that commutates an air current at the backside of the diaphragm 12. Moreover, the current plates 40 are provided on the chassis 31 so as be located at the backside of the diaphragm 12, and their principal surfaces are arranged in a direction along the amplitude direction of the diaphragm 12.

In FIG. 2, because the amplitude direction of the diaphragm 12 is a Y-axis direction illustrated in the present drawing, the principal surfaces of the current plates 40 are arranged along the Y axis. Moreover, the current plates 40 include at least one pair of plates, for example. In FIG. 2, a case is illustrated where the current plates 40 include two pairs of plates and are concentrically arranged from the center of the vibrating part 11.

Specifically, the paired current plates 40 have a straight line C along the Z axis illustrated in the present drawing as a symmetric axis. Therefore, in FIG. 2, a current plate 40*a*1 and a current plate 40*a*2 become paired, and a current plate 40*b*1 and a current plate 40*b*2 become paired. As described above, the left and right areas of the diaphragm 12 are equally covered when viewed from the top by providing the paired current plates 40. Therefore, a design of the current plates 40 as a waterproof plate can be simplified in comparison with the case where the current plates 40 do not become paired.

Herein, it is preferable that the paired current plates 40 are arranged in a non-parallel manner. The reason is because sound reflects between the current plates arranged in parallel to be easily resonated if the current plates 40 are arranged in parallel to each other. Such a resonance causes the degradation of sound quality.

Therefore, it is possible to suppress the resonance of sound and also commutate an air current by arranging the paired current plates 40 in a non-parallel manner. In FIG. 2, as an example of the arrangement of the current plates 40, a case is illustrated where the distance between the lower ends of the principal surfaces of the paired current plates 40 is larger than that between the upper ends of the principal surfaces. A drop of water that falls onto the current plates 40 can be guided to the chassis 31 located at its outer circumferential side by arranging the current plates 40 in such a direction.

However, the embodiment is not limited to the example. The distance between the upper ends of the principal surfaces of the paired current plates 40 may be larger than that between the lower ends of the principal surfaces.

In order that the current plates 40 function as a waterproof plate for protecting the diaphragm 12 from a drop of water falling from the upper side, it is preferable that at least upper ends of the principal surfaces of the current plates 40 are arranged at the upper side than the centroid of the diaphragm 12.

In FIG. 2, as an example, the current plate 40*a*1 is substantially parallel to the current plate 40*b*1, and the current plate 40*a*2 is substantially parallel to the current plate 40*b*2. However, the present embodiment is not limited to this. The unpaired current plates 40 (for example, the current plate 40*a*1 and the current plate 40*b*1) may be arranged in a different direction.

In FIG. 2, as an example, each of the current plates 40 is supported by the chassis 31 and the two arms 32. However, the present embodiment is not limited to this. Both ends of the current plate 40 may be attached to the outer circumferential portion of the chassis 31 to form a bridge therebetween. Alternatively, the current plate 40 may be supported by only the arms 32.

In the meantime, when the current plates 40 include two or more pairs that have different distances from the center (the centroid of the diaphragm 12) of the vibrating part 11 in planar view, it is preferable that the current plates 40 having the different distances have the different widths of the principal surfaces (hereinafter, simply referred to as "widths of principal surfaces") in the amplitude direction of the diaphragm 12.

The reason is because the optimum widths of the principal surfaces are different in accordance with the arrangement positions of the current plates 40 in order that the current plates 40 efficiently commutate an air current. Therefore, it is possible to efficiently commutate an air current by causing the widths of the principal surfaces of the current plates 40 having different distances to be different.

In the example illustrated in FIG. 2, the widths of the principal surfaces of the current plates 40*a*1 and 40*a*2 are narrower than those of the current plates 40*b*1 and 40*b*2. The current plates 40*a*1, 40*a*2 and the current plates 40*b*1, 40*b*2 do not necessarily satisfy the relationship, and thus optimum widths of the principal surfaces derived by an experiment and the like can be applied to these current plates. In this case, there may also be a case where the widths of the principal surfaces of the different paired current plates 40 are equal to each other.

In FIG. 2, as an example, a case is illustrated where the widths of the principal surfaces of the current plates 40 are narrower at the positions closer to the chassis 31. However, the present embodiment is not limited to this. The widths of the principal surfaces may be uniformed, or may be wider at the positions closer to the chassis 31. Moreover, the current plates 40 may be shaped by bending themselves along the outer periphery of the chassis 31, for example.

The frame 30 and the current plates 40 are integrally formed. As a result, the number of components of the speaker unit 1 can be suppressed and thus a production cost can be reduced. It is preferable that the frame 30 and the current plates 40 are made of, for example, resin from the viewpoint of the reduction of the weight of the speaker unit 1. Moreover, the frame 30 and the current plates 40 may be made separately to fix the current plates 40 to the frame 30 with an adhesive or the like.

The shading part 50 is provided on the end portion of the chassis 31, and has, along with the current plates 40, a function, as a so-called waterproof plate, for blocking the fall of a drop of water falling from the upper side onto the diaphragm 12. For this reason, the shading part 50 is provided to protrude from the end portion of the chassis 31 along the amplitude direction of the diaphragm 12 so as to cover a part of the diaphragm 12 when viewed from the top. In FIG. 2, as an example, a case is illustrated where the shading part 50 protrudes along the inner circumferential surface of the chassis 31.

In the meantime, it turns out from an experimental result that an eddy described above is easier to be formed as the dimension of the shading part 50 is larger and thus sound quality is degraded. Therefore, it is preferable that the dimension of the shading part 50 is reduced.

However, because the conventional speaker unit does not include the current plates 40 described above, it is required that the shading part 50 functions as a waterproof plate for the whole area of the diaphragm 12. For this reason, in the conventional speaker unit, it is difficult to reduce the dimension of the shading part 50, and thus it is required that the shading part 50 be provided on one-half of the upside of the chassis 31 in a posture illustrated in FIG. 2, for example.

On the contrary, in the speaker unit 1 according to the embodiment, because the current plates 40 also serves as a waterproof plate as described above, the dimension of the shading part 50 can be reduced more than ever before. As a result, an eddy generated by the shading part 50 can be reduced. Moreover, the speaker unit 1 may have a configuration that the speaker unit does not include the shading part 50.

It is preferable that the current plates 40 are provided in the neighborhood (for example, the upper half of the chassis 31) of the shading part 50. The reason is because an eddy is easy to be generated in the neighborhood of the shading part 50 as described above. Therefore, the generation of an eddy by the shading part 50 can be efficiently suppressed by providing the current plates 40 in the neighborhood of the shading part 50.

Figure 3A:
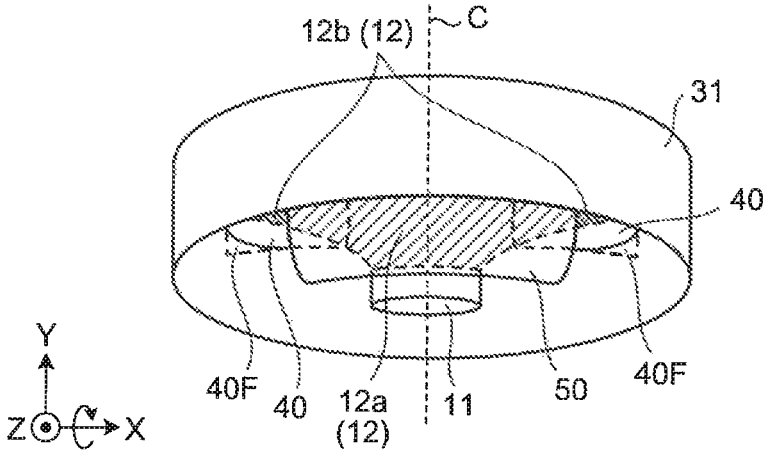
FIGS. 3A and 3B are schematic diagrams illustrating the arrangement of a current plate and a shading part.
Figure 3B:
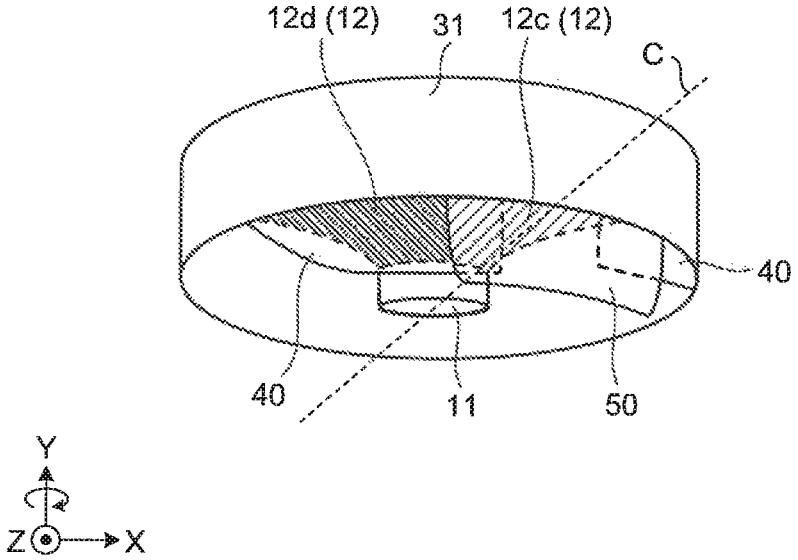

Next, a function of the current plates 40 and the shading part 50 as a waterproof plate will be explained with reference to FIGS. 3A and 3B. FIGS. 3A and 3B are schematic diagrams illustrating the arrangement of the current plates 40 and the shading part 50. Hereinafter, in order to make an explanation understandable, the current plates 40 and the shading part 50 are displayed in a permeable manner, and the descriptions of the arms 32, the attaching parts 35, and the like illustrated in FIG. 2 are omitted.

FIG. 3A is a schematic diagram, when viewed from the top, illustrating the speaker unit 1 in a posture obtained by inclining the speaker unit 1 illustrated in FIG. 2 at an arbitrary angle (for example, 10 degrees) counterclockwise about the X axis toward the positive direction of the X axis. FIG. 3B is a schematic diagram, when viewed from the top, illustrating the speaker unit 1 in a posture obtained by inclining the schematic diagram illustrated in FIG. 3A at an arbitrary angle (for example, 20 degrees) clockwise about the Y axis toward the positive direction of the Y axis.

As illustrated in FIG. 3A, the current plates 40 and the shading part 50 are arranged to cover the whole area of the diaphragm 12 when viewed from the top. Specifically, the shading part 50 is arranged to cover an area 12*a* including the straight line C of the diaphragm 12, and the current plates 40 are arranged to cover a remaining area 12*b* of the diaphragm 12 of which the area 12*a* is covered. by the shading part 50.

As described above, by arranging the current plates 40 and the shading part 50, the current plates 40 and the shading part 50 can block the fall of a drop of water onto the diaphragm 12 from the upper side so as to function as a waterproof plate of the whole area of the diaphragm 12. As a result, because a drop of water does not fall onto the diaphragm 12, the degradation of sound quality due to a drop of water can be suppressed.

The current plates 40 have a shape that does not include an area 40F illustrated with a dotted line in FIG. 3A, for example. This reason is because the area 40F does not cover the diaphragm 12 when viewed from the top. In other words, the reason is because the area 40F does not function as a waterproof plate of the diaphragm 12.

Therefore, because the current plates 40 have a shape that does not include the area 40F that does not function as a waterproof plate, the weight of the current plates 40 can be reduced in comparison with a case where the current plates include the area 40F.

Next, the arrangement of the current plates 40 and the shading part 50 when the speaker unit 1 illustrated in FIG. 3A is rotated around the Y axis by a predetermined angle will be explained with reference to FIG. 3B. Also in this case, the current plates 40 and the shading part 50 are arranged to function as a waterproof plate of the diaphragm 12.

Specifically, as illustrated in FIG. 3B, when viewed from the top, the shading part 50 is arranged to cover an area 12*c* including the straight line C of the diaphragm 12, and the current plates 40 are arranged to cover an area 12*d* of the diaphragm 12 other than the area 12*c* covered by the shading part 50. Moreover, when the speaker unit is rotated around the Y axis in a direction opposite to the case of FIG. 3B, the current plate 40 illustrated at the far side of FIG. 3B is to cover an area other than the area covered by the shading part 50.

As described above, by arranging the current plates 40 and the shading part 50, the current plates 40 and the shading part 50 function as a waterproof plate of the diaphragm 12 even if the speaker unit 1 is attached in different postures. In other words, the speaker unit 1 can be attached in different postures while maintaining a waterproof function.

As illustrated in FIG. 2, because the speaker unit 1 includes two pairs of the current plates 40, the whole area covered by the current plates 40 illustrated in FIGS. 3A and 3B is to be covered by two pairs of the current plates 40. However, the whole area may be covered by one pair of the current plates.

In FIGS. 3A and 3B, it has been explained that the current plates 40 and the shading part 50 cover only the part of the whole area of the vibrating part 11 when viewed from the top. However, the current plates 40 and the shading part 50 may cover the whole area of the vibrating part 11.

In this case, the dirt of the vibrating part 11 can be suppressed. Moreover, when covering only the part of the whole area of the vibrating part 11 as illustrated, because the dimension of the shading part 50 is reduced compared to when the whole area is covered, the generation of an eddy by the shading part 50 can be suppressed.

As described above, the speaker unit 1 according to the embodiment includes the diaphragm 12, the frame 30, and the current plates 40. The frame 30 supports the outer circumferential portion of the diaphragm 12. The current plates 40 are provided in the frame 30 so as to be located at the backside of the diaphragm 12, and their principal surfaces are arranged in a direction along the amplitude direction of the diaphragm 12. Therefore, according to the speaker unit 1 of the embodiment, sound quality can be improved by a simplified structure.

In the meantime, in the embodiment described above, it has been explained that the speaker unit 1 includes two pairs of the current plates 40. However, the embodiment is not limited to this. Therefore, hereinafter, as alternative examples of the speaker unit 1, cases will be explained where the speaker unit includes one pair of the current plates 40 and the speaker unit includes three pairs of the current plates 40. In the following descriptions, only the number of the current plates 40 is different from the explanation of the speaker unit 1 explained already. For this reason, their explanations for the components other than the current plates 40 are omitted.

Figure 4:
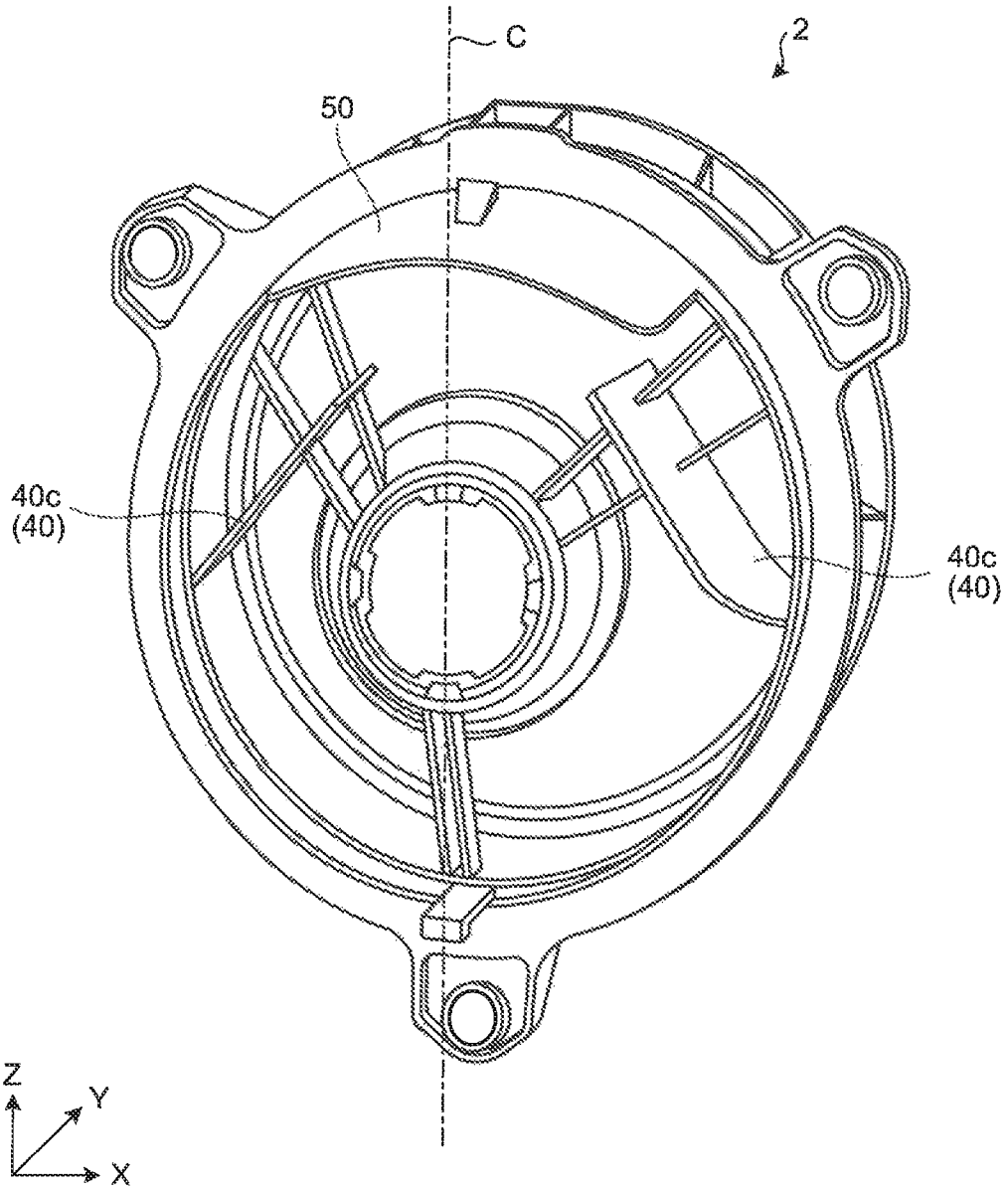
FIG. 4 is a schematic diagram illustrating the backside of the speaker unit according to a first alternative example.

First, a first alternative example for one pair of the current plates 40 will be explained with reference to FIG. 4. FIG. 4 is a perspective diagram illustrating the backside of a speaker unit 2 according to the first alternative example. As illustrated in FIG. 4, the speaker unit 2 according to the first alternative example includes one pair of current plates 40*c*.

The current plates 40*c* are arranged to have the straight line C as a target axis similarly to the speaker unit 1 explained already. Moreover, the widths of the principal surfaces of the paired current plates 40*c* are wider than those of the current plates 40*a*1, 40*a*2 and the current plates 40*b*1, 40*b*2 illustrated in FIG. 2, for example. The reason is because it is required that the diaphragm 12 be covered by the current plates 40 fewer than two pairs of the current plates 40 when viewed from the top.

Figure 5:
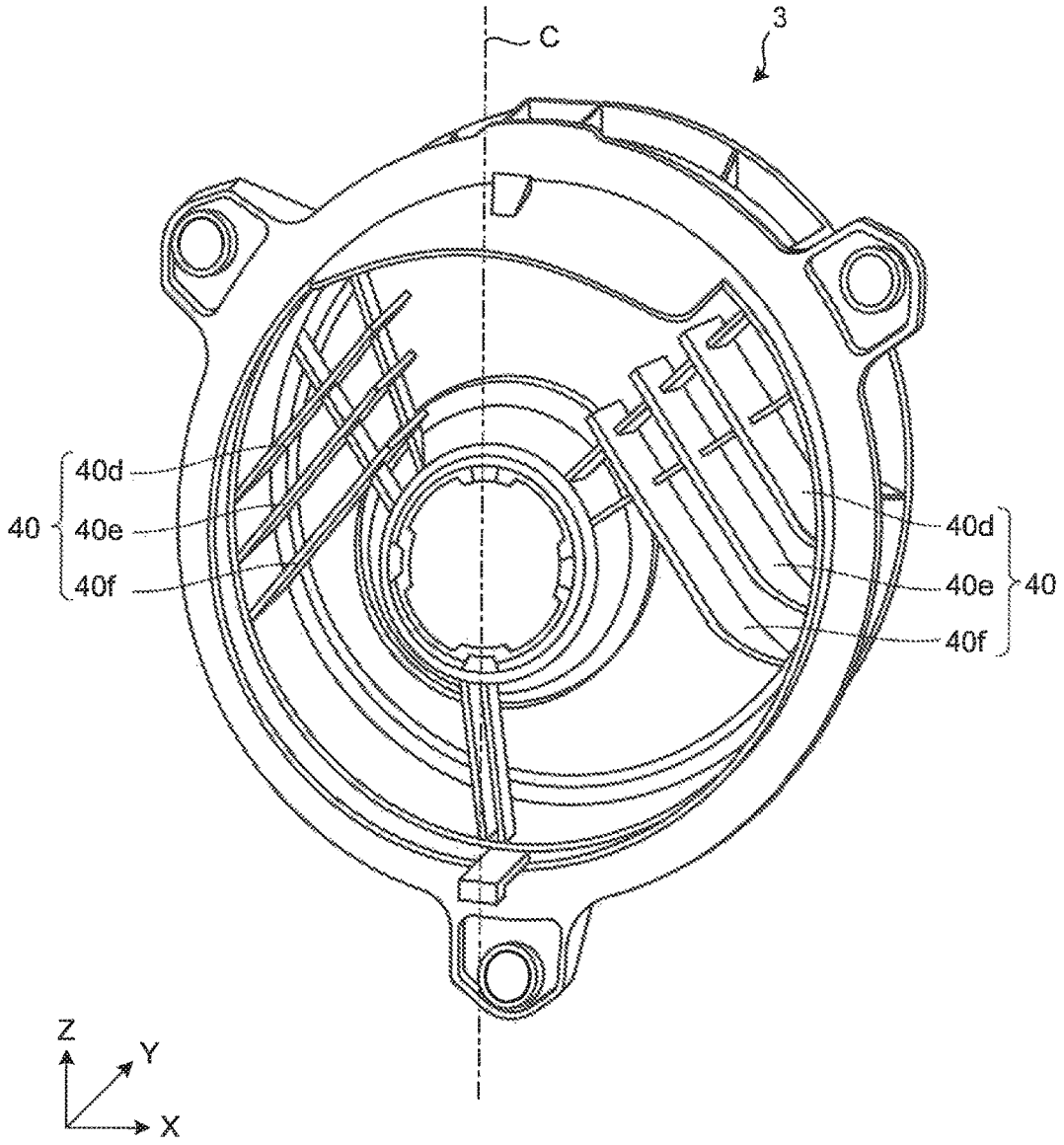
FIG. 5 is a schematic diagram illustrating the backside of the speaker unit according to a second alternative example.

Next, a second alternative example will be explained with reference to FIG. 5. FIG. 5 is a perspective diagram illustrating the backside of a speaker unit 3 according to the second alternative example. As illustrated in FIG. 5, the speaker unit 3 according to the second alternative example includes three pairs of current plates 40*d* to 40*f*. The paired current plates 40 have the straight line C as a target axis similarly to the speaker unit 1 and the speaker unit 2 explained already. The widths of the principal surfaces of the current plates 40 are wider in order of the current plate 40*f*, the current plate 40*e*, and the current plate 40*d*, for example.

As described above, according to the speaker unit 2 and the speaker unit 3 of the first and second alternative examples, even if the current plates 40 are one pair or three pairs, the current plates 40 have a commutation function of an air current and a waterproof function.

In the meantime, in the embodiment and alternative examples described above, it has been explained that any of the speaker units 1 to 3 includes only the paired current plates 40. However, the embodiment and alternative examples are not limited to this. In other words, the current plates 40 may have an unpaired arrangement, or the paired current plates may have different shapes or different widths of their principal surfaces.

Alternatively, the current plates 40 may have four pairs or more. Moreover, the directions of the current plates 40 in the speaker units 1 to 3 described above are only an example.

Therefore, the current plates 40 may be arranged radially from the center of the vibrating part 11.

In the speaker units 1 to 3 described above, it has been explained that the chassis 31 is a substantially cylindrical chassis. However, the chassis 31 can be optionally changed in conformity with the outer circumference of the diaphragm 12. Moreover, it has been explained that the diaphragm 12 is a cone-shaped plate in any drawings. However, the present embodiment and alternative examples are not limited to this. The diaphragm may be a planar diaphragm.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A speaker unit comprising:

a diaphragm;

a frame that supports an outer circumferential portion of the diaphragm;

an arm that extends from the frame towards a vibrating part, the vibrating part being located at a backside of the diaphragm so as to vibrate the diaphragm; and a current plate that is supported by the arm so as to be located at the backside of the diaphragm, the current plate being intersected by the arm, and a principal surface of the current plate being arranged in a direction along an amplitude direction of the diaphragm, the amplitude direction being along a principal axis with which sound produced by the speaker unit emanates.

2. The speaker unit according to claim 1, wherein the current plate includes at least one pair of current plates.

3. The speaker unit according to claim 2, wherein each current plate of the at least one pair of current plates is arranged in a non-parallel manner with respect to the other current plate.

4. The speaker unit according to claim 1, wherein the current plate is arranged to cover a partial area of the diaphragm when viewed from a top view when the diaphragm is placed in a posture in which the diaphragm is erected.

5. The speaker unit according to claim 4, further comprising a shading part that protrudes from an end portion of the frame along the amplitude direction so as to cover the partial area of the diaphragm when viewed from the top view when the diaphragm is placed in the posture, wherein the current plate covers a remaining area of the diaphragm that is not covered by the shading part.

6. The speaker unit according to claim 1, wherein the speaker unit is embedded in a door of a vehicle.

7. The speaker unit according to claim 1, wherein the current plate is formed integrally with the frame.

8. The speaker unit according to claim 2, wherein a distance between lower ends of principal surfaces of the pair of current plates is larger than a distance between upper ends of the principal surfaces.

9. A speaker unit comprising:

a diaphragm;

a frame that supports an outer circumferential portion of the diaphragm; and two or more pairs of current plates that are provided in the frame so as to be located at a backside of the diaphragm, principal surfaces of the current plates being arranged in a direction along an amplitude direction of the diaphragm, the current plates having different distances from a centroid of the diaphragm in planar view, and the current plates having different widths of the principal surfaces in the amplitude direction.

* * * * *